US005964649A

United States Patent [19]

Bergqvist et al.

[11] Patent Number: 5,964,649

[45] Date of Patent: Oct. 12, 1999

[54] GRINDING CUP AND WEAR PART THEREFOR

[75] Inventors: Arne Bergqvist; Peter Nava, both of Sandviken, Sweden

[73] Assignee: Sandvik AB, Sandviken, Sweden

[21] Appl. No.: 08/836,809

[22] PCT Filed: Nov. 21, 1995

[86] PCT No.: PCT/SE95/01386

§ 371 Date: Aug. 11, 1997

§ 102(e) Date: Aug. 11, 1997

[87] PCT Pub. No.: WO96/15874

PCT Pub. Date: May 30, 1996

[30] Foreign Application Priority Data

Nov. 21, 1994 [SE] Sweden ..... 9404008

[51] Int. Cl.[6] ..... B24B 55/02

[52] U.S. Cl. ..... 451/54; 451/450; 451/442; 451/448; 451/449; 451/342; 451/270

[58] Field of Search ..... 451/541, 342, 451/450, 488, 270, 548; 408/56; 76/108.1, 108.6

[56] References Cited

U.S. PATENT DOCUMENTS

| | | | |
|---|---|---|---|
| 4,102,084 | 7/1978 | Bloomquist | 451/450 |
| 4,802,799 | 2/1989 | Rachev | 76/108.6 |
| 5,070,654 | 12/1991 | Manqvist et al. | 451/449 |
| 5,634,747 | 6/1997 | Tukala et al. | 76/108.6 |
| 5,637,037 | 6/1997 | Bergquist | 451/450 |

FOREIGN PATENT DOCUMENTS

| | | |
|---|---|---|
| 2 081 174 | 2/1982 | United Kingdom . |
| WO93/25346 | 12/1993 | WIPO . |
| WO95/00290 | 6/1994 | WIPO . |

*Primary Examiner*—Robert A. Rose
*Assistant Examiner*—George Nguyen
*Attorney, Agent, or Firm*—Burns, Doane, Swecker & Mathis, L.L.P.

[57] ABSTRACT

A grinding cup includes a wear part having a cavity at its front end, the cavity configured for grinding a button of a rock drill bit. A flush channel extends forwardly through the wear part and terminates at the cavity for conducting a flushing medium thereto. The flush channel is spaced from a center axis of rotation of the grinding cup by a distance greater than 2% and less than 30% of a largest diameter of the cavity.

14 Claims, 2 Drawing Sheets

GRINDING CUP AND WEAR PART THEREFOR

TECHNICAL FIELD

The present invention relates to a grinding cup for grinding buttons of a rock drilling bit, said grinding cup including a shank that is rotatably mounted in a grinding machine and a wear part having a recess, said recess carrying out the grinding of the buttons. The invention also relates to a wear part for a grinding cup.

PRIOR ART BACKGROUND

When grinding cemented carbide buttons of a drill bit, a grinding cup of the type described above is normally used. The wear part of such grinding cup usually has an abrasive grinding surface that often includes granular diamond. However, the grinding of cemented carbide buttons generates both heat and abrasive cuttings to such an extent that it is necessary to cool the grinding cup and the button bit as well as to flush away the cuttings. The known prior art technique for such cooling is to supply cooling medium, normally water, through the grinding machine and axially through the grinding cup to provide the cooling medium to be discharged in the region where the wear part of the grinding cup engages the free end of the button.

It is previously known through for example International Publication WO 93/25346 to provide a first flush channel which extends centrally through the shank of the grinding cup and which connects to a second flush channel, terminating centrally in a recess in the wear part of the grinding cup.

That recess cannot perform a grinding function and thus leaves a projection in the center of a ground button. The projection may constitute a starting point for a crack in the button when the rock drill bit is reused and thus it may shorten the length of life of the drill bit.

Furthermore it is previously known to provide a groove extending diametrically over the center of the recess, to spread the flushing medium and whereby the available volume of abrasive material is undesirably decreased.

OBJECTS AND SUMMARY OF THE PRESENT INVENTION

An object of the present invention is to provide a grinding cup for grinding of rock drill bit buttons, configured such that the active surface of the button becomes smooth after grinding and such that cools the button sufficiently. Furthermore the configuration of the grinding cup according to the present invention makes it possible to increase the volume of abrasive material in the wear part of the grinding cup. The objects of the present invention are realized by a wear part that has a flush channel which is spaced from a center axis of the wear part.

DESCRIPTION OF THE DRAWINGS

Below embodiments of a grinding cup according to the present invention will be described, reference being made to the accompanying drawings, where.

DESCRIPTION OF PREFERRED EMBODIMENTS

Figure 1:
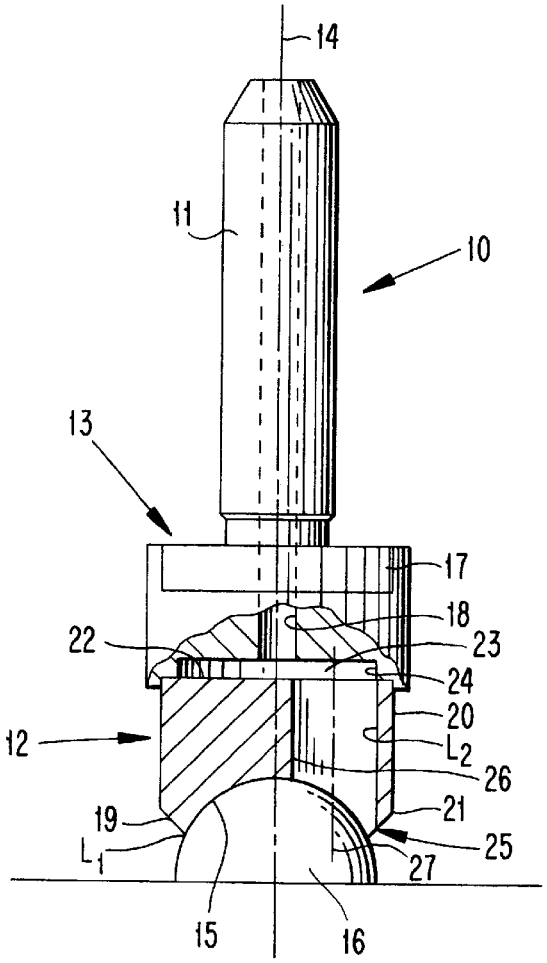
FIG. 1 shows a partly sectioned side view of a grinding cup according to the present invention.
Figure 2:
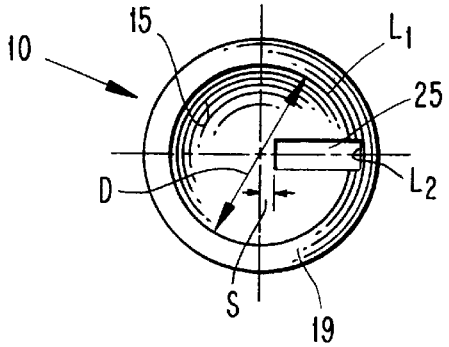
FIG. 2 shows an end view of the grinding cup shown in FIG. 1.

The grinding cup 10 according to primarily FIGS. 1 and 2 includes a shank 11, a wear part 12 and an intermediate portion 13 that bridges the shank 11 and the wear part 12. Preferably the shank 11 and the intermediate portion 13 are in one piece and form a carrier for the wear part 12. The wear part 12 is connected to the intermediate portion 13 in a suitable way, preferably by brazing. The grinding cup 10 is rotatable about to longitudinal centre axis 14.

The free end of the wear part 12 has a cavity 15 in the shape of a segment of a sphere when the button 16, to be grinded, has a hemispherical free end. The button is preferably made of cemented carbide. However, if the buttons have ballistic or conical free ends then the cavity of course has a complementary shape. The cavity 15 is intended to engage and cooperate with the free end of a button that is subjected to grinding. The cavity is equipped with an abrasive material, preferably diamond. The other parts of the cup are preferably made from steel.

In its upper part the intermediate portion 13 of the grinding cup 10 is provided with a key handle 17 that cooperates with driving means of the grinding machine to rotate the grinding cup 10. A central first flush channel 18 extends axially between the free end of the shank 11 and a recess 23. The shank 11 and the intermediate portion 13 may alternatively be configured with other conventional geometries suited for different types of grinding machines, available on the market.

The radially outermost border line $L_1$ of the cavity 15 has a diameter D. Radially outwards of the outer border line $L_1$, the wear part is provided with backed off conical surface 19 or a circular surface perpendicular to the center axis 14. The surface 19 connects to the jacket surface 20 over an obtuse angled corner 21 or a 90° corner. The rear side 22 of the wear part 12 can be planar as in FIG. 1 or recessed as in FIGS. 3 and 4. Alternatively the rear side can be curved. The front side of the Intermediate portion has a recess 23, which is symmetrically arranged about the center axis 14, according to FIGS. 1 and 4. The flush channel 18 terminates centrally in the recess 23 and flush medium can be forced radially outwards in a direction towards the radially outermost border surface 24 of the recess. The diameter of the recess is less than the diameter of the intermediate portion 13 and preferably less than the diameter D of the cavity 15.

Figure 3:
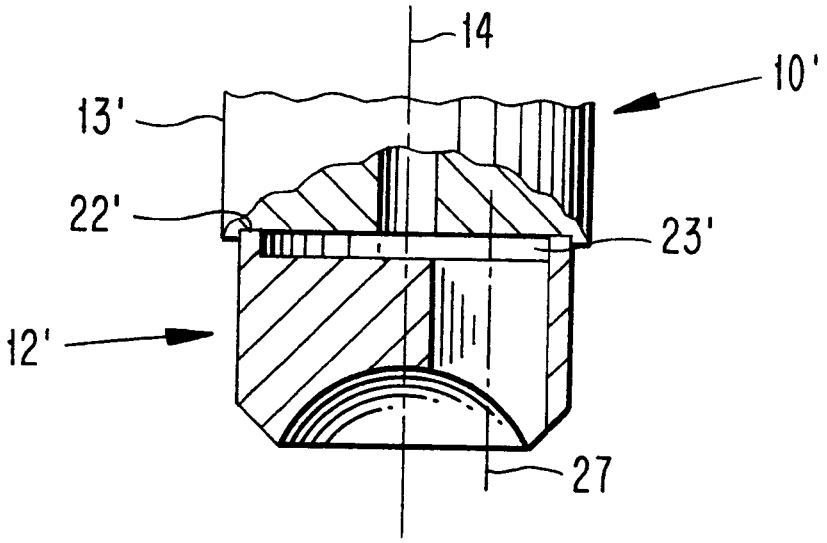
FIGS. 3 and 4 show partly sectioned side views of alternative embodiments of a grinding cup according to the present invention.

In FIG. 3 a front end of an alternative embodiment of a grinding cup 10' according to the present invention is shown, wherein the recess 23' has been arranged centrally in the rear side 22' of the wear part 12' while the front surface of the intermediate portion 13' is planar. The advantage of of this embodiment primarily resides in that the wear part can be secured to a planar end.

Figure 4:
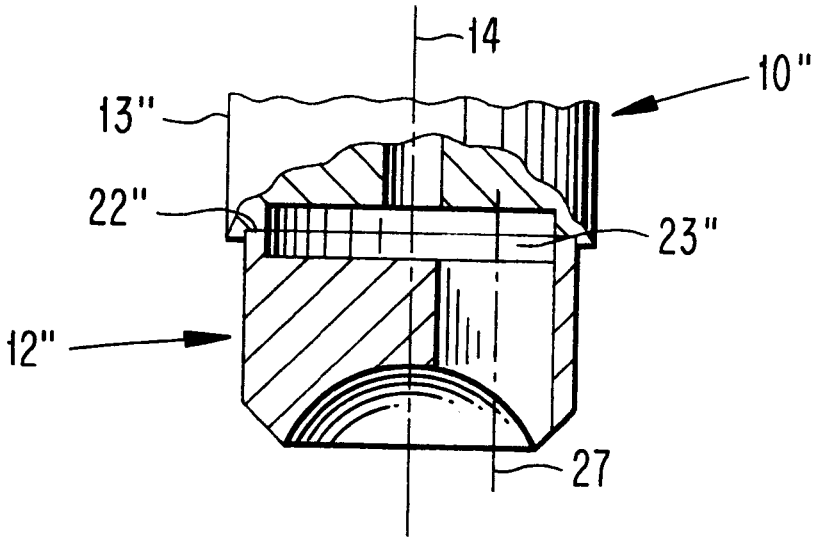

In FIG. 4 a front end of an alternative embodiment of a grinding cup 10" according to the present invention is shown, wherein the recess 23" has been arranged centrally both in the rear side 22" of the wear part 12" and in the front surface of the intermediate portion 13". The advantage of of this embodiment is that there will be a larger space for improved flow of flush medium.

Independent of how the recess is positioned, it forms a space in contact with a second flush channel 25 to promote flow of flush medium to the grinding area on the button 16. The flush channel 25 extends axially forward from the rear side of the wear part in communication with the recess of the wear part axially 23 or 23' or 23" forwards and will terminate at least in the cavity 15. Preferably a portion of the flush channel 25 also terminates in the portion 19 radially outwards of the border line $L_1$.

The flush channel in FIGS. 1 and 2 has a rectangular basic shape see FIG. 2 the short sides of which are spaced apart in a radial direction taken with reference to the center axis 14. The radially inner part or short side 26 of the flush channel is radially separated a distance S from the center axis. The distance S is larger than 2% but preferably less than 30% of the diameter D of the cavity 15. The flush channel has a center axis 27 which is parallel with and radially separated from the center axis 14 of the grinding cup. The radially outermost part of a border line $L_2$ of the outlet of the second flush channel 25 is provided radially outside of the border line $L_1$ of the cavity 15. Through the shape of the grinding cup wherein the second flush channel is spaced radially from the axis of rotation 14, buttons can be ground without the formation of a "wart" or projection on the top of the button, which decreases the risk for premature breakage of the button. Furthermore an uninterrupted flow is obtained since the flush channel 25 cannot be clogged by cuttings during the grinding process. In addition during manufacturing there is no need for accurate positioning of the flush channel of the wear part since the recess allows optional position of the wear part relative to the intermediate portion in the rotational direction.

The described grinding cup 10 functions in the following manner. The grinding cup is mounted in the rotatable spindel of a grinding machine. The grinding cup is then adjusted to match the position of the button to be ground, e.g. in a position where the wear part correctly engages the upper normally active portion of the button. Then the grinding cup 10 is rotated to perform grinding of the button.

From an external source flush medium is supplied to the cavity 15 via the flush hole 18, the space 23 and the flush channel 25. Substantially all cooling medium is to be transferred to the active surface of the button.

Figure 5:
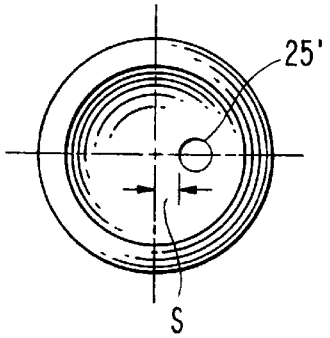
FIGS. 5 to 7 show end views of alternative grinding cups according to the present invention.
Figure 6:
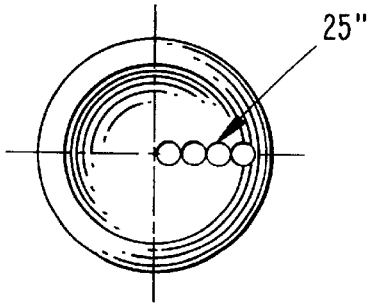
Figure 7:
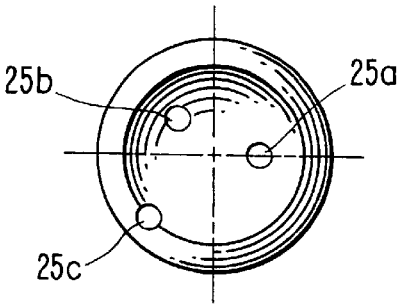

In the end views according to FIGS. 5, 6 and 7 are shown alternative embodiments of grinding cups according to the present invention, which all fit to the above-captioned shank geometries. Thus, FIG. 5 shows a flush channel 25 which is cylindrical and which terminates eccentrically in the cavity 15 only. In FIG. 6 the flush channel is constituted by a number of, at least two consecutively arranged, cylindrical holes 25, which intersect one another or are spaced a short distance from each other, and form a flush channel as described above. The radially outermost border line of the outlet of the flush channel 25 is provided outside the cavity. In FIG. 7 are shown three separate flush channels, 25*a* 25*b* 25*c* each of which is cylindrical, wherein one flush channel extends on both sides of the radially outmost border line of the cavity.

Common for the three latter described embodiments is that buttons can be ground without the formation of a wart on the button top, which reduces the risk for premature breakage of the button. Furthermore during manufacturing there is no need for accurate positioning of the flush channel of the wear part since the recess allows optional position of the wear part relative to the intermediate portion in the rotational direction.

By providing an eccentric flush channel in the wear part the advantages of good cooling and optimal volume of abrasive material.

We claim:

1. A grinding cup adapted to be mounted in a grinding machine and comprising:

a carrier including a shank having a first flush channel extending longitudinally therethrough, and being rotatable about an axis of rotation; and a wear part mounted at a forward end of the carrier, the wear part including a front end in the form of a cavity configured to grind a button of a rock drilling bit, and a plurality of second flush channels each extending from a rear end of the wear part to an outlet disposed at the cavity, the second flush channels communicating with the first flush channel and having their outlets spaced radially from the axis of rotation, the outlet of one of the second flush channels spaced circumferentially from the outlet of another of the second flush channels, wherein a portion of the outlet of one of the second flush channels is disposed radially beyond an outer border line of the cavity, and a remaining portion of the outlet of the one second flush channel is disposed radially inside of the outer border line.

2. The grinding cup according to claim 1 wherein a longitudinal axis of each second flush channel extends parallel to the axis of rotation.

3. The grinding cup according to claim 1 wherein each second flush channel is radially spaced from the axis of rotation by a distance greater than 2% of a largest diameter of the cavity.

4. The grinding cup according to claim 3 wherein the distance is less than 30% of the largest diameter of the cavity.

5. The grinding cup according to claim 1 wherein each second flush channel has a circular cross sectional shape.

6. The grinding cup according to claim 1 wherein a recess is formed in at least one of the carrier and the wear part for communicating a front end of the first flush channel with rear ends of the second flush channels.

7. The grinding cup according to claim 6 wherein the recess is circular, a center of the recess being intersected by the axis of rotation.

8. The grinding cup according to claim 6 wherein the recess is formed only in a front end of the carrier.

9. The grinding cup according to claim 6 wherein the recess is formed only in a rear end of the wear part.

10. The grinding cup according to claim 6 wherein the recess is formed partially in the rear end of the wear part and partially in the front end of the carrier.

11. A wear part adapted to be mounted in a grinding machine, the wear part including a front end in the form of a cavity configured to grind a button of a rock drilling bit, and a plurality of flush channels each extending from a rear end of the wear part to an outlet at the cavity and adapted to conduct a flushing medium to the cavity, the outlets of the flush channels being spaced radially from a center axis of the wear part, the outlet of one of the flush channels spaced circumferentially from an outlet of another of the flush channels, wherein the outlets are radially spaced from the center axis by a distance greater than 2% of a largest diameter of the cavity.

12. The wear part according to claim 11 wherein a longitudinal axis of each flush channel extends parallel to the center axis.

13. The wear part according to claim 11 wherein each flush channel has a circular cross sectional shape.

14. A wear part adapted to be mounted in a grinding machine, the wear part including a front end in the form of a cavity configured to grind a button of a rock drilling bit, and a flush channel extending from a rear end of the wear part to an outlet at the cavity and adapted to conduct a flushing medium to the cavity, the outlet of the flush channel being spaced radially from a center axis of the wear part, wherein a portion of the outlet is situated radially outside of an outer border line of the cavity, and a remaining portion of the outlet is situated radially inside of the outer border line.

* * * * *